US008944801B2

(12) United States Patent
Heymanns et al.

(10) Patent No.: US 8,944,801 B2
(45) Date of Patent: Feb. 3, 2015

(54) PELLET PRESS FOR PRODUCING PELLETS

(75) Inventors: Frank Heymanns, Oberderdingen (DE); Gernot von Haas, Heidelberg (DE); Günter Natus, Mühltal (DE); Detlef Kroll, Eppingen (DE)

(73) Assignee: Dieffenbacher GmbH Maschinen- und Anlagenbau, Eppingen (DE)

( * ) Notice: Subject to any disclaimer, the term of this patent is extended or adjusted under 35 U.S.C. 154(b) by 327 days.

(21) Appl. No.: 13/504,754

(22) PCT Filed: Oct. 30, 2010

(86) PCT No.: PCT/EP2010/006644

§ 371 (c)(1),
(2), (4) Date: Jul. 16, 2012

(87) PCT Pub. No.: WO2011/050987

PCT Pub. Date: May 5, 2011

(65) Prior Publication Data

US 2012/0276237 A1 Nov. 1, 2012

(30) Foreign Application Priority Data

Oct. 30, 2009 (DE) ..... 10 2009 051 481
May 6, 2010 (DE) ..... 10 2010 028 710

(51) Int. Cl.
*B30B 3/04* (2006.01)
*B30B 15/04* (2006.01)
(Continued)

(52) U.S. Cl.
CPC ..... *B30B 11/228* (2013.01); *B30B 15/0023* (2013.01); *B30B 15/04* (2013.01); *B30B 15/047* (2013.01)
USPC ..... 425/331; 100/155 R; 100/159; 100/176; 425/382 R; 425/464

(58) Field of Classification Search
USPC ..... 310/254, 258, 216, 259, 293; 100/155 R, 159, 176; 425/331, 425/DIG. 230, 382 R, 464
See application file for complete search history.

(56) References Cited

U.S. PATENT DOCUMENTS 1,994,371 A 3/1935 Sizer
3,063,361 A 11/1962 Gehrke
(Continued)

FOREIGN PATENT DOCUMENTS

CN 1832299 9/2006
CN 200988319 12/2007
(Continued)

OTHER PUBLICATIONS

International Search Report dated Apr. 28, 2011 as received in corresponding PCT Application No. PCT/EP2010/006644, 7 pages.
(Continued)

*Primary Examiner* — Joseph Del Sole
*Assistant Examiner* — Thukhanh Nguyen
(74) *Attorney, Agent, or Firm* — Foley & Lardner LLP

(57) ABSTRACT

A pellet press for producing pellets from material which is to be compressed. In the pellet press, the biomass is compressed through the holes of the die by at least one press device comprising a roller which rolls on the die, to form pellets. The die and/or the roller move in relation to each other during the production thereof. Provides essential machine elements or modules which are simple to access and also quick to exchange. The construction and operation of the pellet press should be modular so that the production power can be variably adjusted and/or the production is independent of the repairs of individual modules. At least one press device comprising at least one roller and/or the die is arranged inside a press frame in the pellet press, the press frame being embodied in the form of at least one C-frame and/or at least one window frame.

21 Claims, 6 Drawing Sheets

Figure 1:
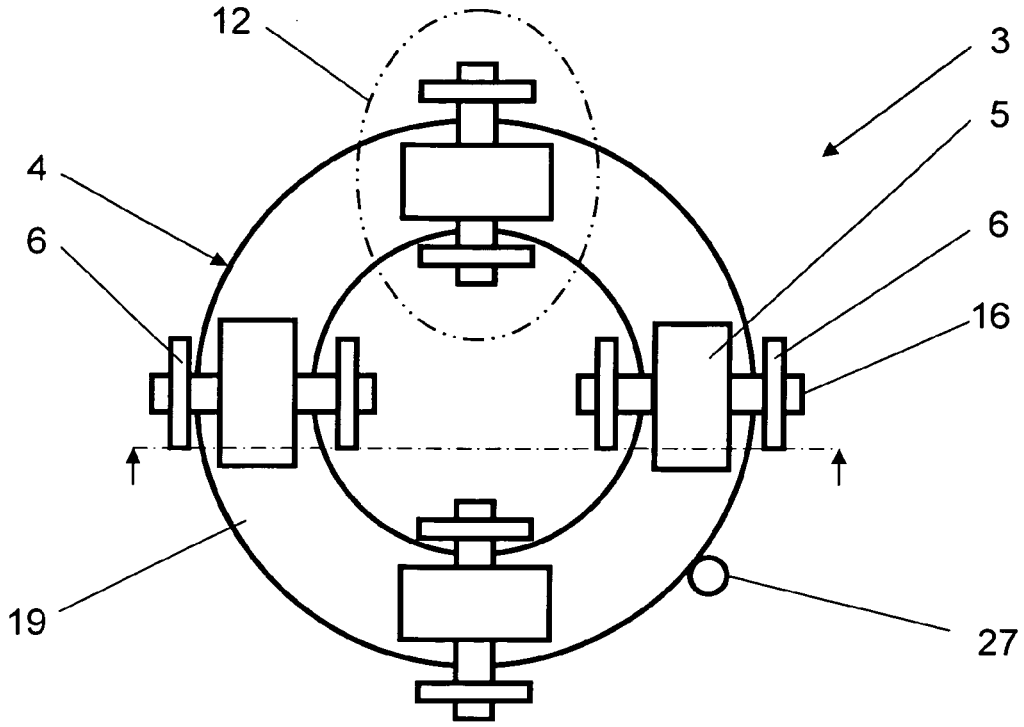

(51) Int. Cl.
*B30B 11/22* (2006.01)
*B30B 15/00* (2006.01)

(56) References Cited

U.S. PATENT DOCUMENTS

| | | | | |
|---|---|---|---|---|
| 3,207,090 | A | 9/1965 | Cunningham | |
| 4,511,321 | A | 4/1985 | Howard | |
| 5,375,513 | A | 12/1994 | Michael et al. | |
| 5,413,487 | A * | 5/1995 | Lundell | 425/331 |
| 6,927,524 | B2 * | 8/2005 | Pyntikov et al. | 310/254.1 |
| 7,241,128 | B2 * | 7/2007 | Blok | 425/331 |

FOREIGN PATENT DOCUMENTS

| | | | |
|---|---|---|---|
| CN | 201109193 | | 9/2008 |
| DE | 42 17 730 | A1 | 12/1993 |
| EP | 0 581 008 | | 2/1994 |
| GB | 2 107 241 | A | 4/1983 |
| JP | 58-065600 | | 4/1983 |
| JP | 63-157800 | | 6/1988 |

OTHER PUBLICATIONS

Office action dated Jan. 26, 2014 issued in connection with Chinese Application No. 201080049665.1.

* cited by examiner

PELLET PRESS FOR PRODUCING PELLETS

CROSS REFERENCE TO RELATED APPLICATIONS

The present invention is a National Stage of International Application No. PCT/EP2010/006644 filed on Oct. 30, 2010, which claims the benefit of German Patent Application No. 10 2010 028 710.5 filed on May 6, 2010 and German Patent Application No. 10 2009 051 481.3 filed on Oct. 30, 2009. The entire disclosures of which are incorporated herein by reference.

The production of pellets, also referred to as granules, from fine material or compacted and/or molten material is already known. The production of pellets, or wood pellets, from preferably chopped biomass, such as wood chips, sawdust, or the like, is also already sufficiently known and is propagated in the field of renewable energy sources as a pioneering technology for climate protection, in particular in Europe. Typically, chip material from the wood-processing industry is used as the raw material, however, freshly cut timber or types of wood which are not usable in the wood-processing industry or waste materials can also be used. Pollutant-free base material is preferably to be used for the market for wood pellets for supplying small furnace facilities in single-family or multi-family houses. Block power plants or special high-temperature furnace facilities for generating heat and/or obtaining electrical energy (combination power plants) can also cleanly combust pollutant-charged material (pellets made of particle board or medium-density fiberboard with or without a coating or lacquering) in small amounts, however.

The wood pellets are typically produced in so-called pelletizing presses, in which the material to be compressed is pressed through boreholes of a matrix by moving and/or actively rolling rollers, also referred to as pan grinder rollers. The material (biomass) is shaped by the boreholes and discharged as strands from the boreholes. Boreholes are understood as all openings which are preferably implemented as essentially cylindrical, and are arranged in a matrix to feed through and shape the material. The boreholes can also have larger intake areas (depressions) to improve the compression procedure and can be hardened or can have hardened sleeves in the boreholes. A differentiation is made between flat and ring matrices in the field of matrices. Rollers revolve externally or internally around on ring matrices for the compression, on flat matrices, the pan grinder rollers roll circularly (mill construction) or linearly reversing. The invention is preferably concerned with flat matrices of the latter construction, but can optionally also be used with ring matrices.

The possibilities for preparing and scattering the biomass, or the post-processing (chopping of the strands, cooling, storage, transport) of the pellets do not have to be discussed in greater detail. Reference is made in this regard to the prior art.

Due to the warming of the climate, which has been acknowledged worldwide in the meantime, the industry has been forced to accelerate and cheapen the large-scale industrial production of wood pellets. However, in particular in large production facilities, which are partially to be assigned to special mechanical engineering or heavy mechanical engineering, large and heavy machine parts are used.

Typical and known pelletizing presses having one or more pan grinder rollers revolving on a circular flat matrix typically have a drive, which drives the flat matrix or the pan grinder rollers via a hollow shaft passing through the flat matrix. The revolving pan grinder rollers are typically mounted overhung on the hollow shaft or the drive via quick-release axles protruding from the hollow shaft. The roller bearings between the quick-release axles and the pan grinder rollers wear very rapidly due to the centrifugal forces and the one-sided loads in the overhung mounting. The restriction of the fundamental system is also concealed in the central drive solution, proceeding from the central middle axis of the flat matrix, because for reasons of the occurring torques or the maximum advisable size of the hollow shaft, the circumference of such a pelletizing press is limited. Simultaneously, a very compact construction results due to the limited circumference, which has the result that maintenance work or repair must be performed in a confined space, which is time-consuming and costly. In the event of damage to the matrix, the rollers, or the bearings, or in the event of clogging of the scattering chamber in front of the roller, these machine elements are only externally accessible, because the central opening of the circular matrix is too small or is occupied by the drive hollow shaft.

The object of the invention comprises providing a pelletizing press for producing pellets, which offers advantages over the prior art in the accessibility of essential machine elements and simultaneously allows the rapid replacement of essential machine elements or modules. In addition, the construction and operation of the pelletizing press are to be modular, so that the production performance is settable variably or independently of repairs of individual modules.

The achievement of the object is that, in the pelletizing press, at least one pressing device comprising at least one roller and/or the matrix is arranged inside a press frame, at least one C-frame and/or at least one window frame being arranged as the press frame.

In an expansion of the object, it is also to be possible, through the modular design and the simple construction of the press frame, to remove individual press frames from the pelletizing press and to continue operation using the remaining press frames during the repair thereof. Scattering of the biomass (not described in greater detail) on the matrix is changed accordingly, so that the quantity of biomass located on the matrix still remains in front of every roller in the limits which are permissible for operation. For example, a scattering device can be provided, which supplies the biomass separately to each roller or one press frame, respectively, and which is additionally installed on the press frame and is accordingly also removed or installed in the event of a removal or an installation.

In particular, in regard to the arrangement of the actuators (typically hydraulic piston-cylinder arrangements), which is not described in all variations and details, it can be installed in the press frame on a plurality of possible points, which is dependent overall on the construction of the pelletizing press. A pelletizing press having a revolving matrix is preferably provided in the drawing, so that the matrix is mounted so it is movable in the press frame by means of bearings and the rollers are arranged to be stationary, but movable toward or away from the matrix. Of course, the bearing of the matrix can also be arranged as movable in this meaning. In another variant, the rollers move in a circle (flat circular matrix) or alternately linearly (rectangular matrix) and the matrix or a matrix table, respectively, is mounted fixedly in the press frames. Of course, a combination of both movements is also conceivable, but probably very complex in the mechanical engineering implementation. In this meaning, at least the roller and/or the matrix would be arranged as movable by means of at least one drive to generate a relative movement. In the case of a large pelletizing press having more than three, preferably having more than five, particularly preferably having more than seven pan grinder rollers, at least two or even more drives are preferably arranged. In the case of movable/rotating rollers or their mounts and/or a rotating/movable matrix, at least one guide means for guiding the movable matrix and/or the roller are arranged inside the pelletizing press, preferably inside at least one press frame. The guide means can be arranged with actuators and/or dampers for setting the running and/or the alignment of the movable machine elements. It is preferably provided in a further embodiment that the rollers and/or the matrix are arranged to be movable in their location to one another in at least one press frame by means of actuators. It is obvious that the actuator therefore cannot only be used for the adjustment, but rather also can introduce forces for pressing the biomass through the matrix. At least one bearing of the movable machine elements (matrix and/or rollers) can be arranged outside a press frame, in order to ensure a sufficient support of the movable machine elements in particular in the case of a small number of press frames. A one-piece or multipart press frame can preferably be arranged as the pressing device. A multipart press frame is particularly preferably formed from at least one crosshead and two tension brackets. The second crosshead can be substituted either independently or by the arrangement of at least one roller or the matrix or its mounts, respectively. In this context, the multipart press frames are preferably connected by rapidly lockable and unlockable connections, particularly preferably bolts, in order to move at least parts of the press frame rapidly and easily out of or into the pelletizing press. For this purpose, at least one engagement surface for the forks of a forklift or for a crane hook is preferably arranged on the press frame of the pressing device. In a particularly preferred exemplary embodiment, multiple pressing devices are arranged in the pelletizing press. These are preferably arranged uniformly along the matrix 4. At least one scattering device, a scattering guide, and/or a side wall can be arranged on at least one pressing device.

A pelletizing press can now be constructed modularly in an advantageous manner according to the teaching of the main application. Therefore, for example, during a longer production time period, the production capacity can be adapted as needed by variation of the press frames, so that excessive or inadequate capacities of pellets to be delivered can be avoided in a simple manner. It is also possible with appropriate design to offer a pelletizing press which can be retrofitted later without problems to a customer, who first purchases a pelletizing press having five pressing devices, for example, which can be retrofitted later with further pressing devices or press frames, respectively.

In a further advantageous effect of the invention, a plurality of parts can be designed in simplified form with respect to facility and mechanical engineering, mass production and also replacement part storage being implemented in significantly simplified and cost-effective form through the manifold identical parts (press frames, tension brackets, crossheads, roller bearings, drives). In a modular pelletizing press having multiple pressing devices or press frames, the press frame particularly preferably has means for accommodating a drive, so that upon expansion of the capacity of a pelletizing press, one drive per pressing device or one drive for every two pressing devices, etc., can also be installed or removed.

The rollers and/or the matrix can execute a stroke due to the actuators in the pressing devices or the press frames, respectively. For example, if the rollers have actuators for a stroke, it is very simple in processing technology in the event of a malfunction in a press frame to move the roller into an idle position and keep it there. The production can continue in the meantime, with the scattering device responsible for this roller optionally being stopped or blocked. This is advantageous in particular if a planned maintenance cycle is approaching or a production cycle will be terminated in the near future and the production must already be stopped for these reasons. It is also conceivable in the case of 24/7 operation that the production can continue slightly reduced in a late shift or night shift until the corresponding maintenance or repair crew begins service on the morning of the next day.

However, it is problematic that for such a modular pelletizing press, a suitable settable drive system is not provided, which can grow or shrink with the pelletizing press. Individual drives must be replaced every two or three press frames, for example, in order to adapt them to the performance. However, transmission ratios in particular also cannot be adapted arbitrarily to different drives. Multiple drives on a large gear ring require additional control-technology expenditure, however, because, for example, one drive must operate speed-controlled and the further drives must operate torque-controlled.

In an expansion of the object, a pelletizing press having movable matrix and/or multiple rollers movable together can be refined so that in conjunction with a modular frame construction, a suitable drive which is preferably adaptable to the required performance can be used.

Therefore, to produce the relative movement between the roller and the matrix, at least one drive is arranged as a direct drive having a rotor and at least one stator, and to move the matrix, the rotor of the drive is arranged on a support plate and/or at least one support ring and/or on the matrix itself, and/or for the simultaneous movement of multiple rollers, the rotor of the drive is arranged on a hollow shaft which is operationally linked to the axles of the rollers. It is therefore now possible to adjust a drive variably to a varying number of press frames and/or roller arrangements, and the drive can be modularly expanded and/or reduced in size and sudden stoppages or blockades in the production, in particular of a moving matrix table, can be reacted to without damage. Furthermore, the drive is adaptable in its required properties to the production circumstances, whether through partial activation/shutdown or installation/removal of driving components. In particular, the disadvantage is overcome that large transmissions or conversion mechanisms for the drive having accompanying noise pollution and also maintenance expenditure may be avoided. Through the minimization of the secondary noise, it is also easier to recognize problems during the pressing based on the noise development.

In a preferred application of similar power providers in form, construction, and/or power consumption, the possibility results of improved installation capability, storage, and repair capability. In particular it is possible to offer different performance concepts (power consumption of the motors in kilowatts) in one press production series, which are also changeable easily and without complication later. For example, the power providers can be constructed so that even-numbered multiples of the power providers can be arranged around the periphery of a stator.

If, in an exemplary embodiment, 64 power providers each having 10 kW can be installed in one stator, a press series could be offered which offers a motor power of 640, 320, 160, or 80 kW, for example, so that a customer can order a small pelletizing press at 160 kW and can later equip it for 320 kW or 640 kW without difficulties by purchasing further power providers, for example, in the case of the pressing of less yielding material or retrofitting further press frames. In this context, the repair may also be made easier, because in the event of disturbances or defects in the drive of a pelletizing press, the entire motor no longer has to be replaced, but rather in the case of a defect of a power provider, only this power provider is still removed and replaced by a new power provider. Power providers are understood in the present invention in this context as, for example, a drive coil winding for the permanent magnets fastened on the rotor. In particular, it is advantageous that the motor does not consist of one unit, but rather a plurality of units, which can accordingly be exchanged or successively installed. This is useful in particular in a tight construction space. In the further meaning, however, this also promotes the storage of identical components (power providers) and the repair capabilities. In particular, it is provided that the power providers are preinstalled on prefinished segments, for example, four 45° elements to form a stator, and these four segments are successively installed in the pelletizing press. In a rotor having radially arranged permanent magnets, for example, the hollow shaft (also parts of the hollow shaft) can be placed in the pelletizing press before or after the installation of the power providers, which is correspondingly advantageous for the construction progress of the pelletizing press itself. A parallel installation, for example, two segments or multiple power providers, then the introduction of the hollow shaft and subsequently the final installation of the remaining elements, is also conceivable, of course. The hollow shaft is preferably first coarsely mounted in the pelletizing press, then the remaining power providers are installed, and subsequently the alignment of the shaft or the rotor in relation to the partially or completely installed stator is performed. Subsequently, the stator segments or individual power providers, respectively, are installed. If this has not already occurred during the installation, the hollow shaft or the support structure of the elements to be driven is installed and an alignment of the internal construction of the motor, i.e., the rotor to the stator, is performed.

Advantages of a Direct Drive:

Through the close construction of a direct motor, preferably in direct proximity to a matrix or the support structure to be moved, varying load in the drivetrain can be relayed on the output side in a manner harmless to the system, the overall stiffness of the drivetrain being able to be significantly increased and/or the overall length of the drivetrain being able to be minimized simultaneously. The required installation space of the pelletizing press having a direct drive can be substantially optimized and reduced in size, and simple measures may be implemented for noise damping of essentially the drivetrain by encapsulation. The pelletizing press can be implemented having a low overall height, which results in advantages in particular in the supply of the pelletizing press with biomass and the removal of the pellets.

Furthermore, in the advantageous arrangement of the direct drive, in particular within the required and stiffening support structures of the pelletizing press, a significantly stiffer drive system results and, accompanying this, a reduction of the shaft torsion or of the drivetrain, respectively. If the hollow shaft is driven as the main drive shaft by motors located far away, the torsion of the hollow shaft has a disadvantageous effect on the overall drive system. The longer the distance between the motor and the matrix plane or the roller plane, respectively, the softer the drive system, and control oscillations occur, because the driven hollow shaft acts like a torsion spring.

An improved control-technology quality of the overall system of the pelletizing press also results. Through the high stiffness of the drive system and the precisely settable torque and angular position regulation of the drive, processing data can be detected directly from the peripheral velocity and therefore the throughput per hour. The press does not have any additional mechanical transmission elements (e.g., transmission stages) due to the direct drive and less oscillation and noise results. Friction losses, torsion, tooth flank play, etc., are eliminated. Permanent magnet motors, in particular in the case of a high drive power, still have a quite high noise level, however. However, the noise emissions can be significantly reduced by the improvements with respect to a compact construction, which can be more easily encapsulated, and the overall efficiency of the press is also significantly improved, because substantially less unused force occurs due to the torsion or the torque absorption in the bearings in the case of an overhung mounting of the motor. Furthermore, such an embodiment can be encapsulated more easily in order to dampen noises. The preferred arrangement of the direct drive would be provided between the matrix plane and at least one further substantially parallel spaced-apart delimitation plane, the distance between the matrix plane and the delimitation plane being +/−500 mm along the matrix axis. In an alternative dimensioning rule, the force introduction areas would be arranged essentially in a transmission area, the suitable transmission area being located between the matrix plane and at least one further delimitation plane, the delimitation planes being arranged at a delimitation angle of 0 to 30° in relation to the matrix plane and having a common intersection point S on the matrix axis with the matrix plane. A delimitation angle of 0 to 25°, in particular 0 to 20°, is particularly preferred.

As already mentioned, the matrix and/or at least one roller can be movable in at least one press frame by means of the drive in the pelletizing press. The stator is preferably at least partially operationally linked to a press frame. The direct drive is preferably a permanent magnet motor having permanent magnets arranged on the rotor. Other direct drives having direct shaft drive, and also other or newer direct drives can also be provided, the hollow shaft or an equivalent support structure for the drive/mounting of at least two rollers and/or the matrix preferably being considered to be the shaft here. The stator of the drive is preferably implemented in a segmented embodiment, at least two power providers which can be separately electronically activated being arranged in combination. In the case of multiple power providers, they may be installed individually or in groups. In a segmented stator, at least one power provider can also be arranged on at least one press frame. Furthermore, it is preferable for the rotor of the drive to be implemented in one piece with the matrix and/or the support plate and/or the support structure of the roller connection or the matrix. The direct drive is preferably arranged in its plane, in particular in the central (geometric center) plane, perpendicularly to the matrix axis, the plane being led at least through one roller, through an axis of the rollers, through the matrix, a support structure to be assigned thereto, and/or through a hollow shaft. It is therefore simultaneously ensured that unnecessary torsion torques are avoided on an extended support structure or a hollow shaft, in order to avoid torsion tensions. At least the stator of the drive is to consist of at least two power providers, the power providers are to be implemented as independent and replaceable units, and the power providers are to be operationally linked individually or sectionally to a control unit by means of supply lines.

Methods, in particular for operating a pelletizing press, may also be recognized from the mentioned possibilities with respect to the many possibilities.

Further advantageous measures and embodiments of the object of the invention are disclosed in the subclaims and the following description with the drawing.

Figure 2:
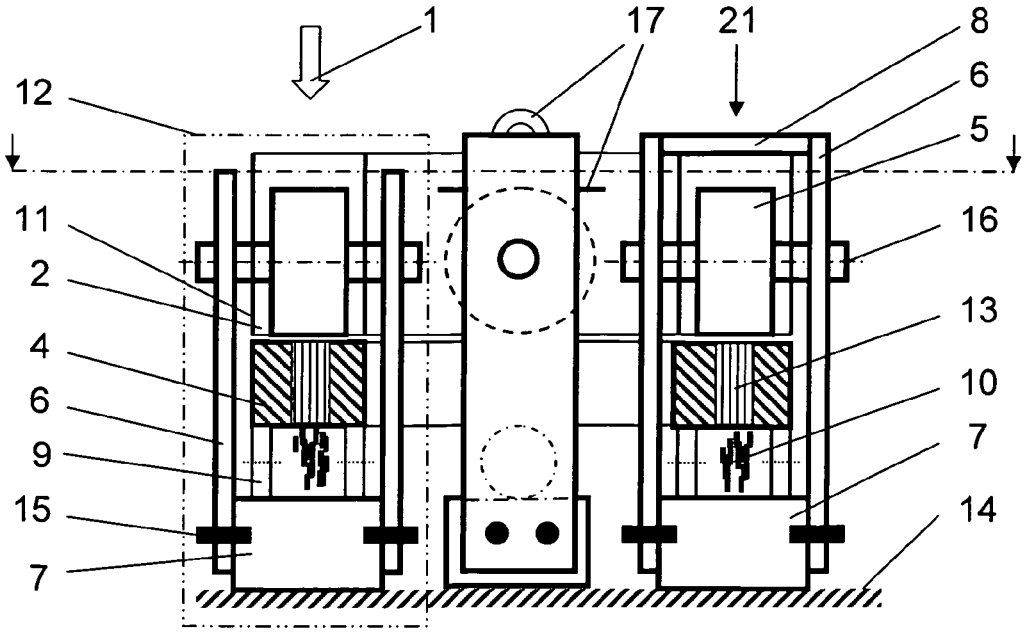
Figure 3:
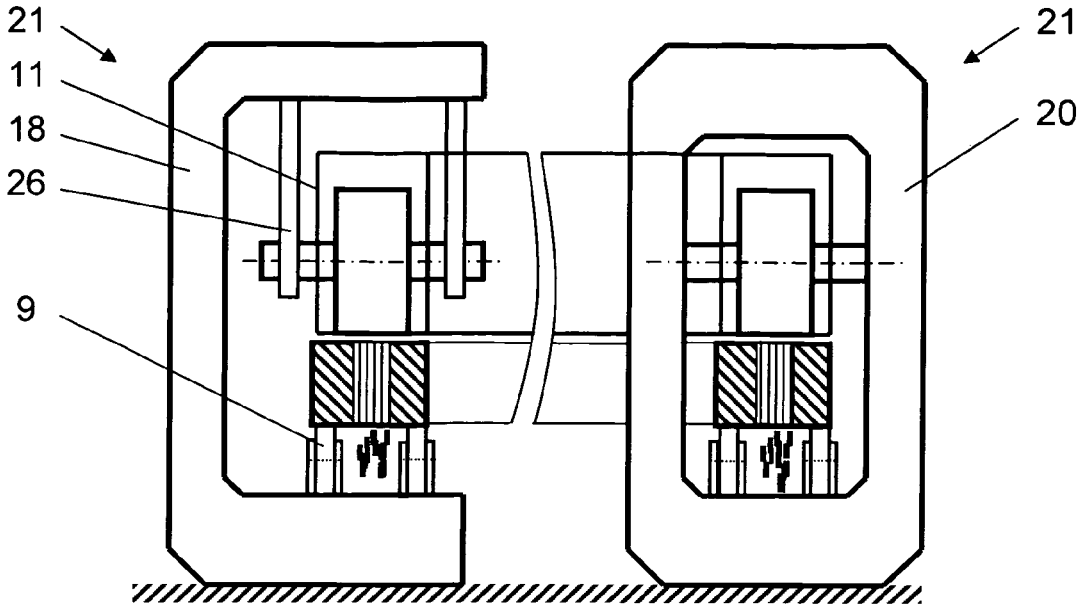
Figure 4:
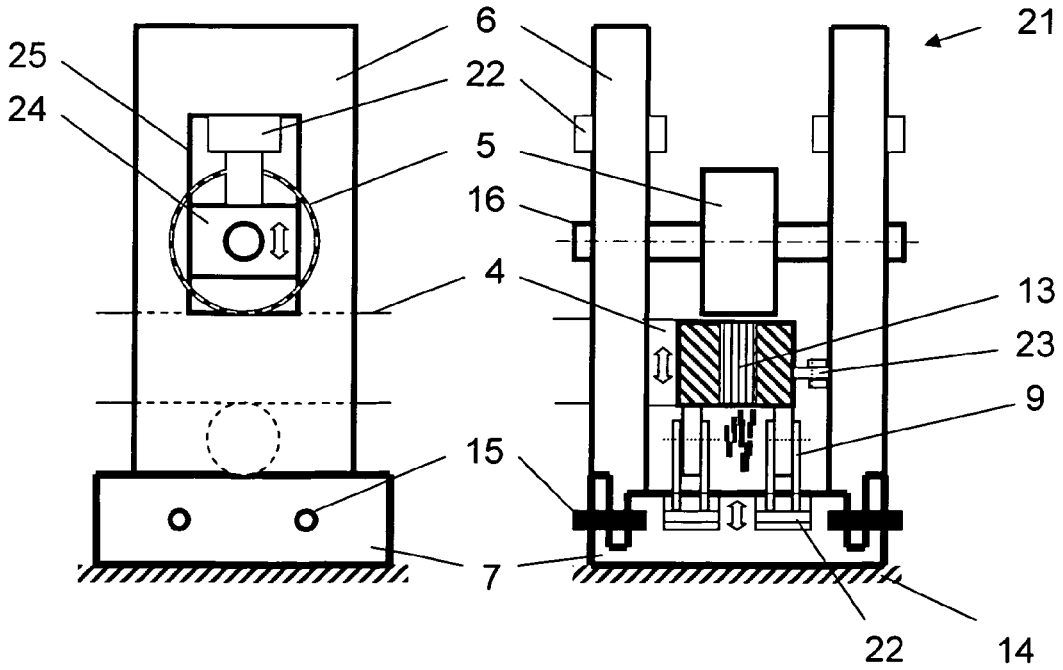
Figure 5:
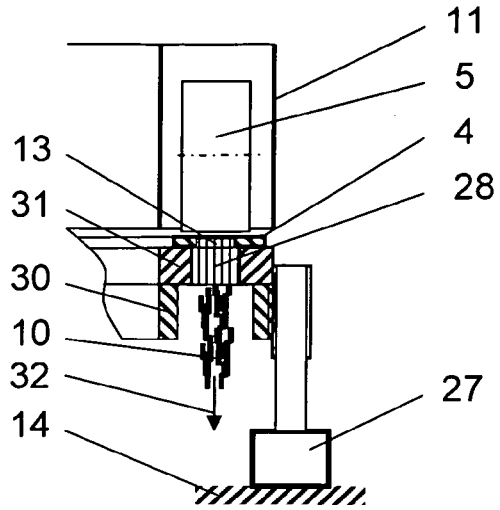
Figure 6:
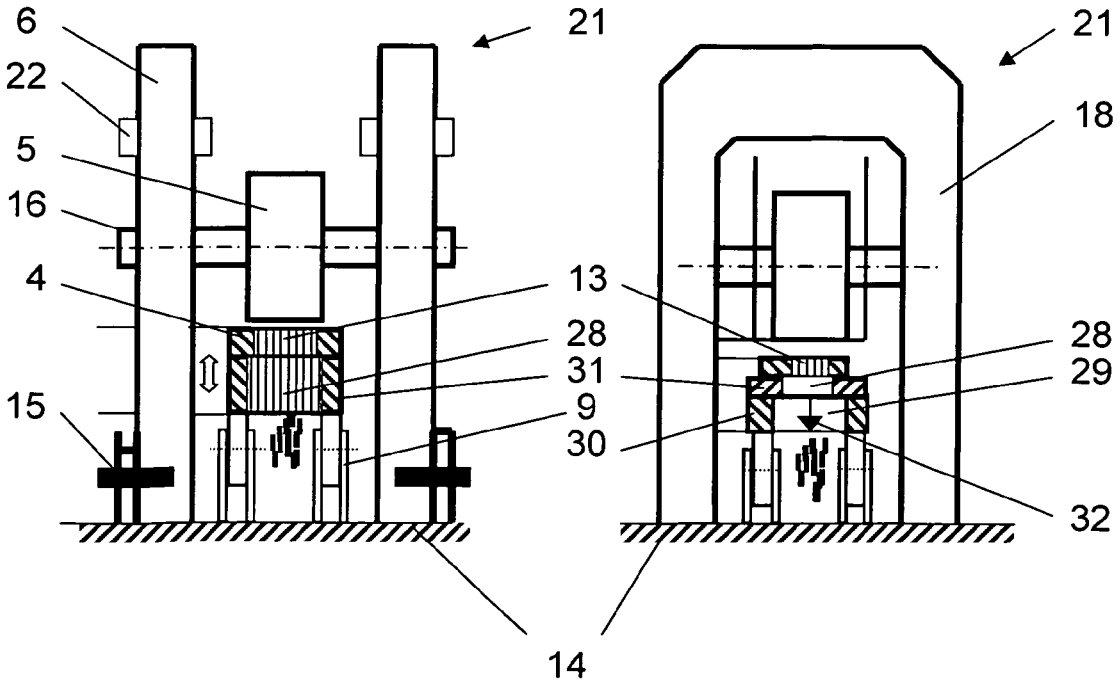
Figure 7:
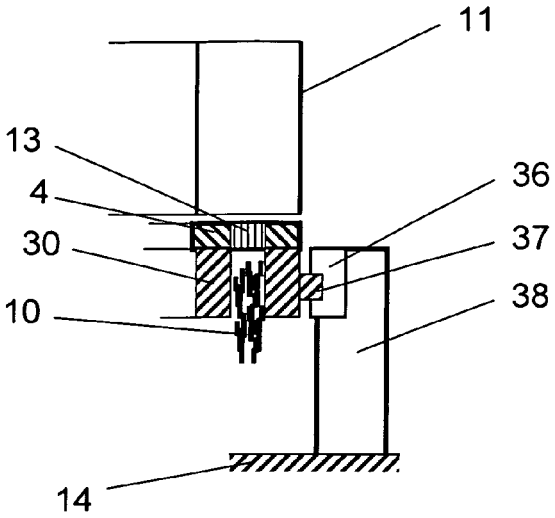
Figure 8:
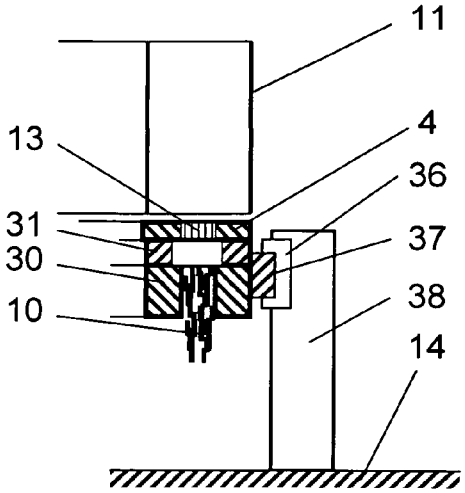
Figure 9:
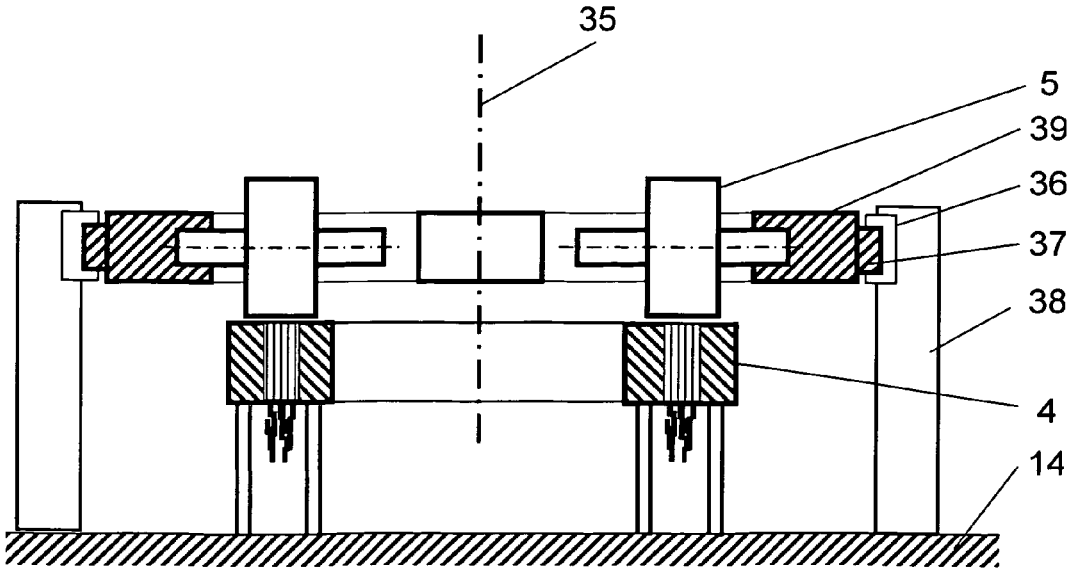
Figure 10A:
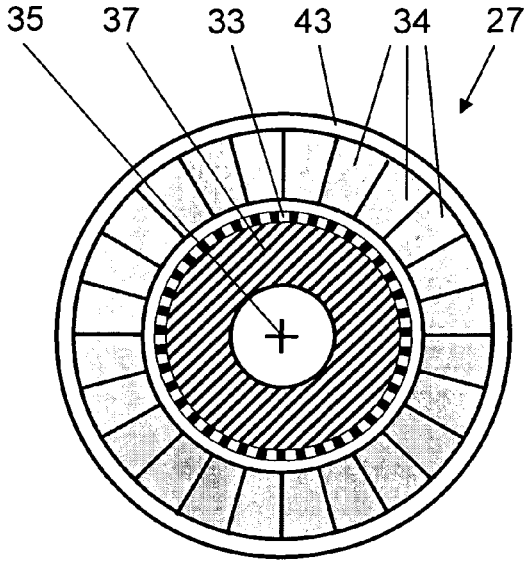
Figure 10B:
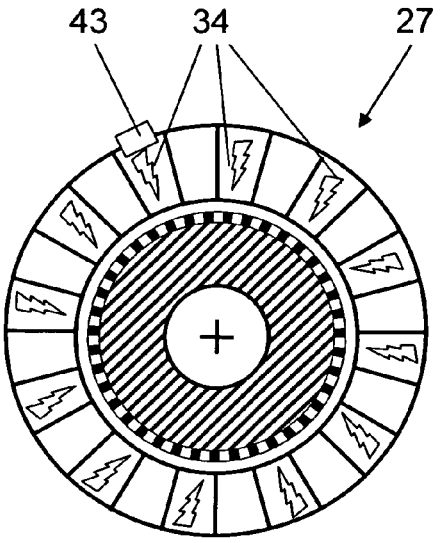
Figure 10C:
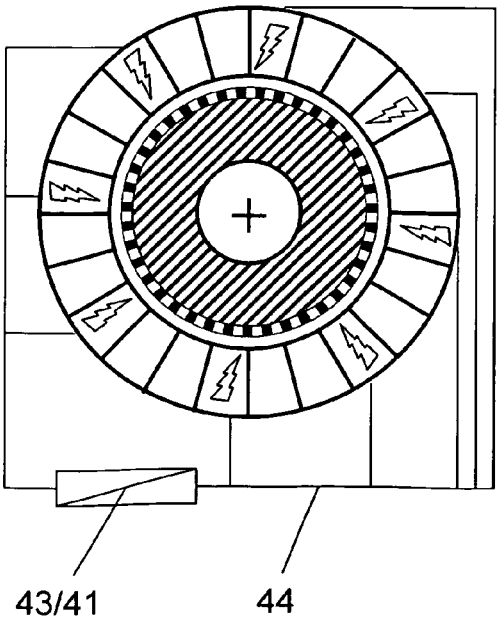
Figure 10D:
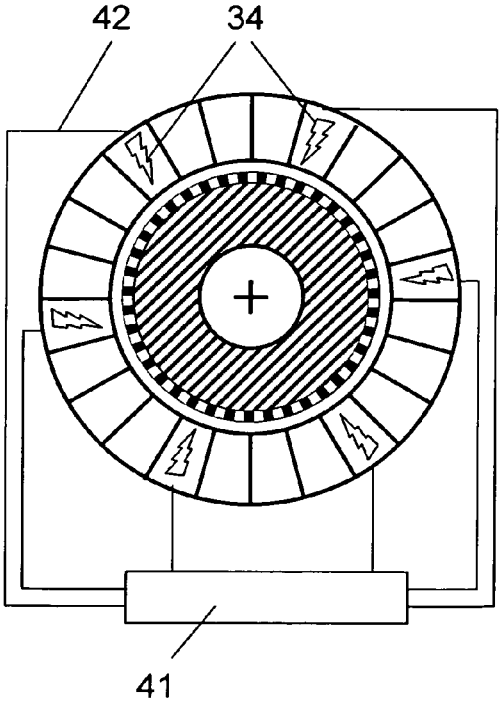
Figure 11:
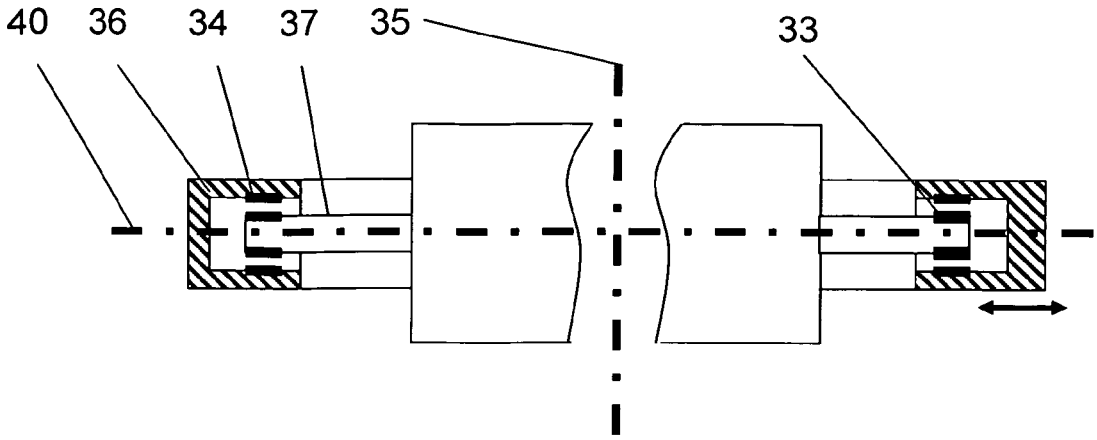
Figure 12:
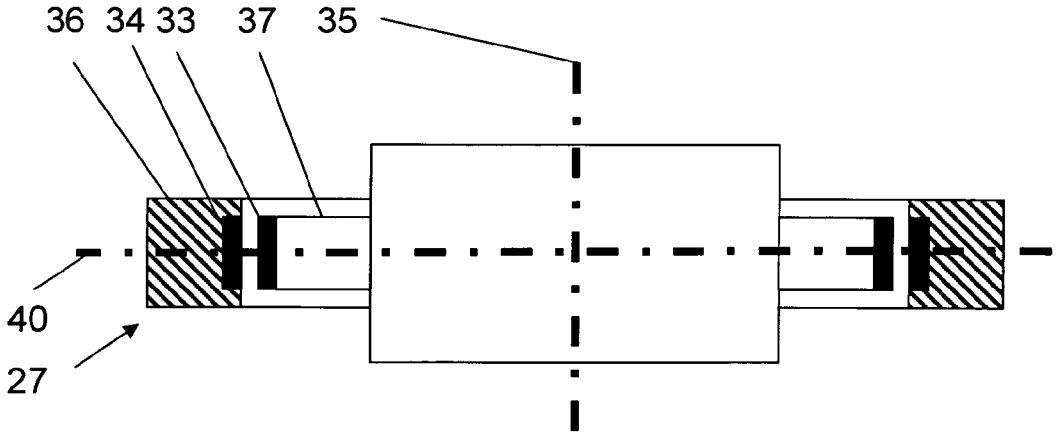
Figure 13:
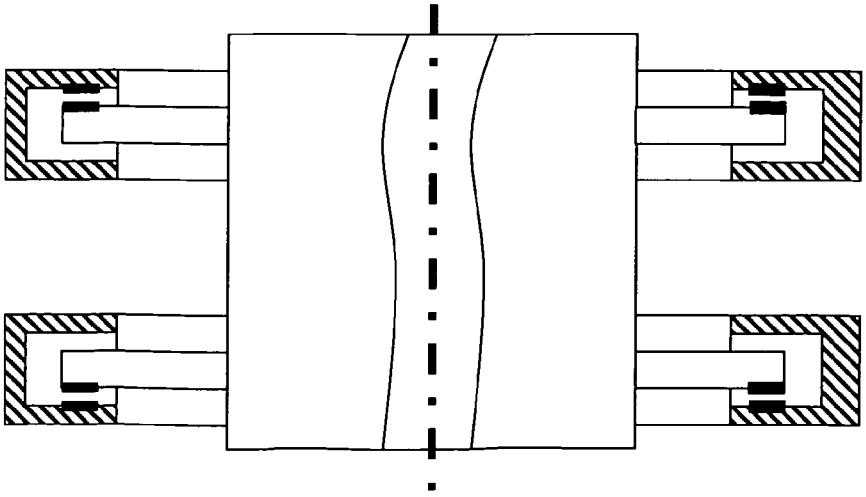

In the figures:

FIG. 1 shows a top view of a circular flat matrix and multiple rollers rolling thereon in four pressing devices or press frames, respectively, the flat matrix being mounted so it is movable in the press frames and rotating around its axis in this preferred embodiment, FIG. 2 shows a side view in the section according to FIG. 1, FIG. 3 shows a comparison of two different press frames having a C-frame (left) and a one-piece window frame (right), FIG. 4 shows two side views of a multipart press frame or a constructed press frame, respectively, having emphasized illustration of possible actuators for adjusting the location of the matrix and/or the rollers to one another, FIG. 5 shows a multipart construction of a movable but also stationary support device for a matrix consisting of a support table and two coaxial support rings having an original drive, FIG. 6 shows an exemplary embodiment of a foundation-based pelletizing press, FIG. 7 shows a possible embodiment of the implementation of the rotor or the arrangement of a stator on an independent stator carrier, respectively, FIG. 8 shows a further variation of the drive having an expanded composite of the rotor not only with the support structure (support rings), but rather having a support plate which supports the matrix for the most direct possible drive force transmission to the matrix, without the replaceable matrix being part of the rotor, FIG. 9 shows an alternative pelletizing press having a hollow shaft arranged coaxially to the central matrix axis for absorbing the drive forces of the direct drive outside the diameter of the matrix for moving the rollers, FIG. 10 shows four schematic sectional views of a direct drive consisting of a stator and a rotor on a hollow shaft having different numbers of the power providers, FIG. 11 shows a possible illustration of a direct drive having a power provider which envelops the permanent magnets on a rotor, FIG. 12 shows a further possible alternative of a direct drive having radial external permanent magnets for the simplified removal and installation, FIG. 13 shows a particularly preferred arrangement of two direct drives for mutual magnetic force compensation.

A pelletizing press 3 having four pressing devices 12 is shown in FIG. 1 in a preferred exemplary embodiment. However, partially as a function of the internal or external diameter of the matrix, a plurality of pressing devices 12 can also be arranged in the pelletizing press 3. In the present preferred exemplary embodiment, the matrix 4 having the rolling surface 19 for the rollers 5 is mounted so it is movable in the pressing devices 12 and is driven by at least one motor (not shown) to execute a circular movement around the axis of the matrix 4. Optional motors for the drive of the rollers 5 in the pressing devices 12 are not shown.

FIG. 2 shows, in a section according to FIG. 1, the pelletizing press 3 on a foundation 14, in the schematic sectional illustration, a press frame 21 having a multipart press frame being arranged, which is made of at least one lower crosshead 7 and two tension brackets 6, the axis 16 of the roller 5, which is mounted in the tension brackets, being held so it is movable with the aid of corresponding machine elements or bearings, respectively. During the rolling on the rolling surface 19 of the matrix 4, the biomass 1 is compressed through the boreholes 13 to form pellets 10. The introduction of the biomass 1 between the side walls 11 of the pelletizing press 3 is only schematically shown. The driven matrix 4 in this example is supported by means of bearings on the lower crosshead 7 and therefore effectively and uniformly terminates the present load flow. In addition to the intrinsic weight of the rollers 5, actuators (22 shown in FIG. 4) can also be arranged, which, in addition to a possibly required spacing setting between roller 5 and matrix 4, can also ensure a required force introduction onto the material to be compressed, or the biomass 1, respectively. It is comprehensible that in the drawing, the illustration of the pressing device 12 or the press frames 21 has priority, and for reasons of clarity the illustration of obvious and known mechanical facility parts was omitted. To illustrate possible variants of an installed press frame 21, the pressing device 12 does not have a separate upper crosshead 8 on the left side, as shown in the right illustration. With the aid of corresponding bearings, the axis 16 of the roller 5 can assume the function of the upper crosshead 8.

In a preferred exemplary embodiment, multipart press frames have locks or bolts 15, using which they can be disassembled rapidly. It is helpful if parts of the press frame 21 have engagement surfaces 17, using which a lifting device, for example, a crane hook (not shown) and/or at least one forklift fork, can be operationally linked to a part of the press frame 21 and can easily remove at least this part from the pelletizing press 3 or also introduce it. For example, if the bolts 15 on the lower crosshead 7 of the press frame 7 are disengaged, the two tension brackets 6 can be withdrawn upward with the roller 5 and its axle 16 without problems from the pelletizing press 3. This method is particularly advantageous because the lower crosshead 7 can still remain on the foundation 14 and can continue to perform the mounting of the matrix 4 during a resumed operation of the pelletizing press 3. This variant is particularly preferred having an additional upper crosshead 8 or an upper crosshead 8 which can be plugged on or provided in the case of the introduction or removal of a segment of the multipart press frame 21. It is to be noted that if a multipart ring-shaped matrix is used, it can be disassembled and a closed window frame 20 can also be removed from the pelletizing press, if necessary.

FIG. 3 shows a comparison of two different press frames 21 having a C-frame 18 and a one-piece window frame 20. It is also shown to the contrary that the roller 5, or the axle 16, is mounted in separate support arms 26 on the left side of the figure, while in contrast on the right side of the figure, the roller 5 is arranged in the vertical branches of the closed window frame 20. These two alternatives would obviously be exchangeable and are also conceivable in still other variants depending on the embodiment of the pelletizing press 3, in particular in the case of a rotation of the rollers 5 (not shown) and a stationary matrix 4.

FIG. 4 shows two side views of a multipart press frame 21 of a pressing device 12 having emphasized illustration of possible actuators 22 for adjusting the location of the matrix 4 and/or the rollers 5 to one another. To adjust the roller 5 in or on the press framework 21 in at least one tension bracket, a window 25 or an equivalent opening or a protrusion thereon is attached, on which at least one actuator 22 and/or a bearing 24 is arranged, so that the roller 5 is movable as shown by a double arrow in the vertical direction away from the matrix 4 or toward the matrix 4. The bearings 9 of the matrix 4 can also be arranged as adjustable by means of a actuator 22. In particular using a hydraulic cylinder-piston arrangement, forces can be caused in the pressing device to promote the compression of the biomass. The actuator can advantageously also act as a vibration damper of the pelletizing press 3. An exemplary radially arranged guide means 23 can be arranged on the press frame 21, in order to help in an assisting manner in the guiding or true running of the matrix 4.

It is particularly advantageous in a vertically-adjustable matrix 4 that the removal of a bearing 9 from the press frame 21 is simplified if the actuators 22 extend further press frames 21 and raise the matrix. Alternatively, of course, the matrix 4 can also be raised by means of external aids or the tension brackets 6 are first raised after removing the bolts 15 and subsequently the bearings 6 are changed. However, this is rather rarely necessary, because according to the teaching of the invention, improved accessibility of the pressing device 12 to the pelletizing press is possible, which makes cleaning and maintenance significantly easier. In particular, the possibility exists of performing work within the matrix ring in the case of circular matrices 5. In an embodiment of a pelletizing press 3 having a moving matrix 4 and stationary rollers 5, it is advisable to provide at least two pressing devices 12, particularly preferably at least three pressing devices 12. For a high production performance, the number of the pressing devices is dependent on the circumference or the size of the matrix 5. In the case of a small number of pressing devices, it can be necessary to provide additional bearings outside the pressing devices in order to ensure the stability of the moving parts during the operation. Moreover, it can be advisable to provide the motors for driving the matrix and/or the rollers directly in the press frames. The required drive power, which is typically dependent on the number of the rollers, can therefore be adapted directly to the number of the pressing devices (rollers).

Moreover, a pressing device 12 can also be constructed from multiple press frames, if the design of the pelletizing press 3 requires it. For example, a press frame can consist of multiple C-frames and/or window frames or multipart window frames arranged parallel to one another. A preferred embodiment is if only one matrix 4 or at least one roller 5 is always arranged stationary in a pressing device 12, the compressing thrust bearing executing a relative movement in each case and being mounted accordingly in the pressing device 12 or the press frame, respectively. The mounted thrust bearing (typically the matrix) passes through further pressing devices or press frames in the course of the production. Of course, the rollers 5 can also be mounted as movable in the pressing device and the matrix 4 can be stationary. In this case, the support means of the rollers 5 pass through the further pressing devices or press frames, if provided, in the course of the production.

A preferred application would be a foundation-based pelletizing press. A C-frame or U-frame open on one side is arranged in a pressing device 12 in such a manner that the open side is arranged in the direction of the foundation 14 and the matrix 4 is guided through the opening thus resulting. The bearings 9 can be arranged directly on the foundation 14, or a corresponding guide can be arranged on the foundation, if the bearings 9 are arranged on the table device, or the support rings 8 and/or the support plate 31, respectively. In a multipart or a one-piece press frame, the tension brackets 6 or the press frame can be fixed by means of bolts 15 on a fastening means arranged on the foundation 14. Both press frames can be lifted off of the foundation, preferably after opening a quick-release device. In both variants, the foundation substitutes for the required lower crosshead.

A multipart construction of a movable support device for a matrix 4 consisting of a support plate 31 and two coaxial support rings 30 having an exemplary drive 27 is shown in FIG. 5. Depending on the torques to be applied, it can be necessary to implement the teeth of the transmission as coarsely as possible and to overlap multiple machine elements.

FIG. 6 shows an exemplary application of a foundation-based pelletizing press 3. A C-frame or U-frame open on one side is arranged on the right in such a manner that the open side is arranged in the direction of the foundation 14 and the matrix 4 is guided through the opening thus resulting. The bearings 9 can be arranged directly on the foundation 14, or a corresponding guide is arranged on the foundation, if the bearings 9 are arranged on the table device, or the support ring 8 and/or the support plate 31, respectively. A multipart press frame is shown on the left side, which is fixed by means of bolts 15 on a fastening means arranged on the foundation 14. Both press frames can be lifted off of the foundation, preferably after opening a quick-release device. In both variants, the foundation substitutes for the required lower crosshead.

On the left in FIG. 6, the matrix 4 is only mounted on the support plate 31, the opposing openings 28 of each borehole 13 being shown clearly here, the openings being larger than the boreholes 13 and accordingly not being a compressing component of the matrix 4. Moreover, a pressing device 21 can also be constructed from multiple press frames 21, if the design of the pelletizing press 3 requires it. For example, a press frame can consist of multiple C-frames and/or window frames 18, 20 or multipart window frames 6, 7 (8) arranged parallel to one another. The press frames 21 are preferably operationally linked (not shown) by means of a connection in the area of the foundation 14 and/or essentially in the area of the rollers 5. It is also conceivable that roller bearings are arranged on the press frame 21 or on the support rings 8 or on the support plate 31 as the bearings 9, in the case of an arrangement of the roller bearings on the support rings 8 or on the support plate 31, a rolling surface for the bearings, which connects the press frames 21, being arranged.

FIG. 7 shows an indirect drive of the matrix 4, which is mounted on at least one, preferably two concentrically mounted support rings 30. At least one of the support rings 30 implements a part of the rotor 37 and is driven by means of the stator 36 of the drive 27, the stator 36 being mounted stationary on a stator support 38 which is operationally linked to the foundation.

FIG. 8 shows an alternative embodiment in which the matrix 4 is arranged on a support plate 31, which is in turn operationally linked to the support rings 30. The rotor 37 is directly operationally linked to the support plate 31 and/or to the support rings 30.

FIG. 9 shows an alternative of a pelletizing press 3 having an externally arranged hollow shaft 39 and a direct drive arranged thereon as the drive 27. The hollow shaft 39 additionally or at least partially implements the rotor 37, which is driven via the stationary stator 36 and the power providers 34 arranged therein. The rollers are mounted overhung on the external hollow shaft 39. Alternatively to this arrangement, a support structure, in which the shafts 5, or their axles, respectively, are mounted, could also be driven via the rotor 37.

FIG. 10 shows four schematic sectional views of a drive 27 implemented as a direct drive, consisting of a stator 36 made of multiple power providers 34 and a rotor 37, operationally linked to a matrix, a structure (support plate) or the like holding the matrix 4. The stator 36 of the motor 27 consists of twenty-eight (FIG. 10*a*), twelve (FIG. 10*b*), eight (FIG. 10*c*), or alternately six (FIG. 10*d*) power providers 34, which are implemented as independent and exchangeable units. The power providers 34 are arranged radially to the matrix axis 35 and the power providers 34 are operationally linked individually or sectionally to a control unit 41 by means of supply lines 42. The areas which are not marked by a lightning sign and are therefore free for optional power providers 34 are depicted for clarity and for better illustration of the power providers 34, which are exchangeable with one another. Of course, it is also conceivable that three power providers 34 are always arranged adjacent one another while leaving open one free area. In particular, it is advantageous if, in the case of multiple power providers 34, at least two power providers 34 having an equivalent performance and/or an equivalent external shaping are arranged. Shaping is understood as the external dimensions or the arrangement of significant installation elements. The power providers 34 are preferably arranged in groups of at least two. The possibility of connecting the power providers 34 directly or indirectly via a suitable mount to the press frame 21 of a pressing device 12 or a stator carrier 38 is not shown. FIGS. 10*b* and 10*c* show the possibility that at least one cooling device 34 is arranged either centrally on the stator 36 or on at least one power provider 34.

The individual supply lines and their exemplary pathway to a control unit 41, which preferably consists of at least one frequency converter, are shown in FIGS. 10*c* and 10*d*. In FIG. 10*c*, the supply lines 42 are combined into supply segments 44 and are alternately supplied directly or to a combined station of control unit 41 and cooling device 43. This is advisable in particular if the control unit 41 also requires continuous cooling. It is not shown that at least parts of the stator 36 and/or supply lines 42 can implement an installation unit.

FIGS. 11 and 12 show a typical and particularly preferred embodiment of the direct drive as the drive 18. In FIG. 11, a drive 27 is arranged as a direct drive on a hollow shaft. A stator 36, which has multiple drive units or power providers 34, is arranged directly opposite, coaxially to the hollow shaft or to the matrix axis 35, respectively. According to FIG. 12, the power providers 34 are implemented as U-shaped, the stator 36 having the permanent magnets arranged thereon engaging in the opening of the U-shaped power provider 34. The permanent magnets 33 are particularly preferably arranged on both sides respectively on the axial external front sides of the rotor 36. The power providers 34, in their property for providing a drive torque in relation to the permanent magnets, preferably have drive windings or coils, through which current flows.

With respect to a method (not shown in greater detail in the figures) for producing a pelletizing press 3, at least the rotor 37 is moved with or at least with a part of the hollow shaft into the at least partially installed pelletizing press 3 and held temporarily essentially in the area of the motor 27 or arranged ready for operation, subsequently the stator 36 being produced by installing individual power providers 34 or by installing a prefinished installation group made of at least two power providers 34 in the area of the drive. The power providers 34 are particularly preferably connected individually or sectionally to a control unit 41 by means of supply lines 42.

The power providers 34 essentially correspond to a motor coil, using which the permanent magnets 33 can be driven. The more motor coils are arranged, the more power can be generated on the rotor 37 and the drive power increases accordingly. The permanent magnets and/or the power providers/motor coils are preferably arranged in the pelletizing press 3 in such a manner that a magnetic force compensation (FIGS. 11 and 12) results. Of course, this magnetic force compensation cannot always be implemented, for example, if the installation space for the drive is restricted or is location-dependent in the scope of the design and layout of the machine elements. Problems can also result in the installation of a large direct drive, in particular having problematic installation space conditions, which require or only allow a special type of the drive itself.

According to FIG. 13, at least two drives 27, which are preferably activatable separately from one another, are provided as a direct embodiment along the matrix axis, in the case of a one-sided spoke arrangement (FIG. 11 is a two-sided spoke arrangement for the permanent magnets), as shown in this figure, the permanent magnets only being arranged on one flat side of the rotor. Therefore, uncompensated magnetic forces result, which act on the hollow shaft or the rotor along the matrix axis, because the matrix axis is perpendicular to the matrix surface and corresponds to the rotational axis of the matrix. This illustration is very schematic and is not provided with reference numerals. With respect to the method, it may be stated that a partial or a segmented stator, respectively, may correspondingly be slipped over such a rotor. However, the stator does not have to be implemented in the U-shape shown, but rather also typical geometric shapes are conceivable if adapted to the properties of the drive and the installation space.

LIST OF REFERENCE NUMERALS 1390/1409

1 biomass
2 compaction chamber
3 pelletizing press
4 matrix
5 roller
6 tension bracket
7 lower crosshead
8 upper crosshead
9 bearing matrix
10 pellets
11 side wall
12 pressing device
13 boreholes
14 foundation
15 bolts
16 axle roller 5
17 engagement surface
18 C-frame
19 rolling surface
20 window frame
21 press frame
22 actuator
23 guide means
24 bearing axle 16
25 window
26 support arms
27 drive
28 openings
29 ring chamber
30 support ring
31 support plate
32 pressing direction
33 permanent magnet
34 power provider
35 matrix axis
36 stator
37 rotor
38 stator carrier
39 hollow shaft
40 plane of the drive 18
41 control unit
42 supply line
43 cooling device
44 supply segment

The invention claimed is:

1. A pelletizing press for producing pellets from material to be compressed, preferably from biomass for use as fuel in furnaces, the biomass comprising fibers, chips, or shreds containing cellulose and/or lignocellulose, the pelletizing press comprising:

a matrix having a plurality of boreholes for compression of the biomass;

a plurality of pressing devices each comprising at least one roller configured to roll on the matrix, the matrix and the at least one roller being movable in a relative movement to one another via at least one drive during production, wherein each pressing device is arranged inside a press frame in the pelletizing press, and wherein the press frame comprises at least one C-frame and/or at least one window frame.

2. The pelletizing press according to claim 1, wherein at least one guide configured to guide the matrix and/or the at least one roller is arranged inside the pelletizing press.

3. The pelletizing press according to claim 1, wherein the rollers at least one roller and/or the matrix is arranged to be movable relative to the other in their location in the press frame via actuators.

4. The pelletizing press according to claim 1, wherein a one-piece or a multipart press frame is arranged in a pressing device.

5. The pelletizing press according to claim 4, wherein engagement surfaces for forks of a forklift or for crane hooks are arranged on the press frame of a pressing device.

6. The pelletizing press according to claim 1, wherein the pressing devices are arranged uniformly along the matrix.

7. The pelletizing press according claim 1, wherein at least one scattering device, a scattering guide, and/or a side wall is arranged on at least one pressing device.

8. The pelletizing press according to claim 1, wherein at least one bearing and/or a guide for the at least one roller and/or the matrix is arranged outside the press frame.

9. The pelletizing press according to claim 8, wherein two coaxial support rings, which expose the boreholes, are arranged between the matrix and the at least one bearing.

10. The pelletizing press according to claim 1, wherein, to produce the relative movement between the at least one roller and the matrix, at least one drive is arranged as a direct drive having a rotor and at least one stator, and to move the matrix, the rotor of the drive is arranged on a support plate, at least one support ring, on the matrix itself, or a combination thereof, wherein a pressing device includes multiple rollers, and/or the rotor of the drive is arranged on a hollow shaft which is operationally linked to axles of the multiple rollers for simultaneous movement of multiple rollers.

11. The pelletizing press according to claim 10, wherein the stator is operationally linked to at least one press frame.

12. The pelletizing press according to claim 10, wherein the stator of the drive is arranged in a segmented embodiment.

13. The pelletizing press according to claim 12, wherein in the case of a segmented stator, at least two electronically separately activatable power providers are arranged.

14. The pelletizing press according to claim 12, wherein, in a segmented stator, at least one power provider is arranged on at least one press frame.

15. The pelletizing press according to claim 10, wherein the rotor of the drive is implemented in one piece with the matrix, the support plate of the matrix, at least one support ring of the matrix, a hollow shaft for the axles of the multiple rollers or the matrix, or a combination thereof.

16. The pelletizing press according to claim 10, wherein at least the stator of the drive comprises at least two power providers, the power providers are implemented as independent and exchangeable units, and the power providers are individually or sectionally operationally linked to a control unit by means of supply lines.

17. The pelletizing press according to claim 13, wherein in the case of multiple power providers, at least two power providers having an equivalent power and/or an equivalent external shaping are arranged.

18. The pelletizing press according to claim 17, wherein the power providers are arranged in groups of at least two.

19. The pelletizing press according to claim 10, wherein a permanent magnet motor is arranged as the direct drive and the permanent magnets are arranged on the rotor.

20. The pelletizing press according to claim 1, wherein the at least one guide is arranged inside the press frame.

21. A pelletizing press for producing pellets from material to be compressed, the material including biomass for use as fuel in furnaces, the biomass comprising fibers, chips, or shreds containing cellulose and/or lignocellulose, the pelletizing press comprising:

a plurality of press frames, each press frame comprising at least one C-frame and/or at least one window frame;

a matrix having a plurality of boreholes for compression of the biomass;

a plurality of pressing devices, each pressing device including a portion of the matrix and at least one roller configured to roll on the matrix, the matrix and the at least one roller being movable in a relative movement to one another via at least one drive during production, wherein each pressing device is arranged inside one of the plurality of press frames in the pelletizing press such that a portion of the matrix and at least one roller are arranged inside each of the press frames.

* * * * *